US007069619B2

(12) United States Patent
Bowden et al.

(10) Patent No.: US 7,069,619 B2
(45) Date of Patent: Jul. 4, 2006

(54) UPRIGHT VACUUM CLEANER EQUIPPED WITH CONVERSION VALVE AND DEAD HEADED WAND

(75) Inventors: Jason D. Bowden, Danville, KY (US); Jason R. Gieske, Danville, KY (US); Thomas J. Fedorka, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 376 days.

(21) Appl. No.: 10/212,302

(22) Filed: Aug. 5, 2002

(65) Prior Publication Data

US 2004/0060144 A1 Apr. 1, 2004

(51) Int. Cl.
*A47L 5/32* (2006.01)

(52) U.S. Cl. ..... 15/335; 15/334

(58) Field of Classification Search ..... 15/331, 15/334, 335, 421

See application file for complete search history.

(56) References Cited

U.S. PATENT DOCUMENTS

| | | | | |
|---|---|---|---|---|
| 2,046,684 | A * | 7/1936 | Hoover | 15/334 |
| 3,869,751 | A | 3/1975 | Boyd et al. | |
| 4,225,999 | A * | 10/1980 | Martinec et al. | 15/330 |
| 4,443,910 | A | 4/1984 | Fitzwater | |
| 4,563,789 | A | 1/1986 | Berfield | |
| 4,573,236 | A | 3/1986 | Dyson | |
| 5,115,951 | A * | 5/1992 | Leslie et al. | 222/533 |
| 5,134,750 | A | 8/1992 | King et al. | |
| 5,243,734 | A | 9/1993 | Maurer et al. | |
| 5,351,361 | A | 10/1994 | Buchtel | |
| 5,355,549 | A | 10/1994 | Steinberg et al. | |
| 5,560,074 | A | 10/1996 | Graham et al. | |
| 6,079,077 | A | 6/2000 | Kajihara et al. | |
| 6,295,694 | B1 | 10/2001 | Dyson et al. | |
| 6,442,791 | B1 * | 9/2002 | McRae Thomson et al. | 15/334 |
| 6,533,871 | B1 * | 3/2003 | Zahuranec et al. | 15/334 |
| 2003/0101535 | A1 * | 6/2003 | Gammack et al. | 15/335 |

* cited by examiner

*Primary Examiner*—Theresa T. Snider
(74) *Attorney, Agent, or Firm*—King & Schickli, PLLC

(57) ABSTRACT

A floor care apparatus includes a housing having a nozzle assembly with a suction inlet and a canister assembly. A dirt collector and suction generator are carried on the housing. The apparatus further includes a wand having an inlet opening and a sealing element for sealing that inlet opening when the wand is held in a storage position. Additionally, the apparatus includes a valve and an airflow conduit system. The airflow conduit system provides fluid communication between the suction inlet, the inlet opening, the valve, the dirt collector and the suction generator. The valve is selectively displaceable between a closed position whereby the suction inlet is sealed off from fluid communication with the suction generator and an open position whereby the suction inlet is provided in fluid communication with the suction generator.

13 Claims, 4 Drawing Sheets

20
10
18
22
30
28
16
12
14
26
26

UPRIGHT VACUUM CLEANER EQUIPPED WITH CONVERSION VALVE AND DEAD HEADED WAND

TECHNICAL FIELD

The present invention relates generally to the floor care field and, more particularly, to a floor care apparatus incorporating a novel air flow control system and to that air flow control system.

BACKGROUND OF THE INVENTION

Upright vacuum cleaners and extractors have become increasingly popular over recent years. Both floor care apparatus generally incorporate a nozzle assembly that rides on wheels over the floor surface to be cleaned. A canister assembly is pivotally mounted to the nozzle assembly. The canister assembly includes an operating handle that is manipulated by an operator to move the floor care apparatus to and fro across the floor. The canister assembly also includes a dirt collector that traps dirt and debris while substantially clean air is exhausted by an electrically operated fan that is driven by an onboard motor. It is this fan and motor arrangement that generates the drop in air pressure necessary to provide the desired cleaning action.

Many upright vacuum cleaners and extractors also provide a cleaning wand that is manipulated by the hand and used to clean areas typically not reachable or generally regarded as cleanable with the suction inlet of the nozzle assembly. Such apparatus are also equipped with multiple position valves that allow the operator to convert the apparatus between floor cleaning through the suction inlet of the nozzle assembly and special task cleaning through the inlet opening of the wand. Such valves must be able to seal off either the suction inlet or the inlet opening. In order to allow for efficient cleaning the valves must provide a good seal and, accordingly, they must be manufactured to precise tolerances. Since the valves must precisely seal two different pathways, the valves are relatively expensive to produce. The present invention avoids this problem by providing a valve which is only utilized to selectively seal off the suction inlet. A separate sealing element is provided for sealing off the inlet opening of the wand when the wand is not in use.

SUMMARY OF THE INVENTION

In accordance with the purposes of the present invention as described herein, an improved floor care apparatus is provided. That floor care apparatus includes a housing having (a) a nozzle assembly equipped with a suction inlet and (b) a canister assembly. The canister assembly may be pivotally connected to the nozzle assembly.

The apparatus also includes a dirt collector as well as a suction generator that are both carried on the housing. A wand is also provided having an inlet opening. A sealing element seals the inlet opening when the wand is held in a storage position.

Still further, the apparatus includes a valve and an airflow conduit system. The airflow conduit system provides fluid communication between the suction inlet in the nozzle assembly, the inlet opening in the wand, the valve, the dirt collector and the suction generator. The valve is selectively displaceable between a closed position whereby the suction inlet is sealed off from fluid communication with the suction generator and an open position whereby the suction inlet is in fluid communication with the suction generator.

Still further describing the invention, the apparatus may also include a pressure relief valve carried on the housing. The pressure relief valve reduces the load on the suction generator when the sealing element is sealing off the inlet opening of the wand and the valve is sealing off the suction inlet of the nozzle assembly by allowing the passage of ambient air through the suction generator.

The airflow conduit system of the apparatus may be further described as including four airflow pathways. The first airflow pathway is provided between the wand and the valve. The second airflow pathway is provided between the suction inlet and the valve. The third airflow pathway is provided between the valve and the dirt collector. The fourth airflow pathway is provided between the dirt collector and the suction generator.

The dirt collector may be a dirt cup or other reusable container whether it be rigid or flexible. Alternatively, the dirt collector may be a disposable bag.

In accordance with yet another aspect of the present invention an airflow control system for a floor care apparatus is provided. That airflow control system includes a sealing element for sealing off the inlet opening of the wand when the wand is not in use and a valve selectively displaceable between a closed position sealing off the main suction opening of the nozzle assembly from the suction generator and an open position providing fluid communication between the main suction opening and the suction generator. Still further that airflow control system may also include a pressure relief valve that functions in the manner previously described.

In the following description there is shown and described one possible embodiment of this invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification illustrates several aspects of the present invention, and together with the description serves to explain the principles of the invention. In the drawing.

Reference will now be made in detail to the present invention, an example of which is illustrated in the accompanying drawing.

DETAILED DESCRIPTION OF THE INVENTION

Figure 1:
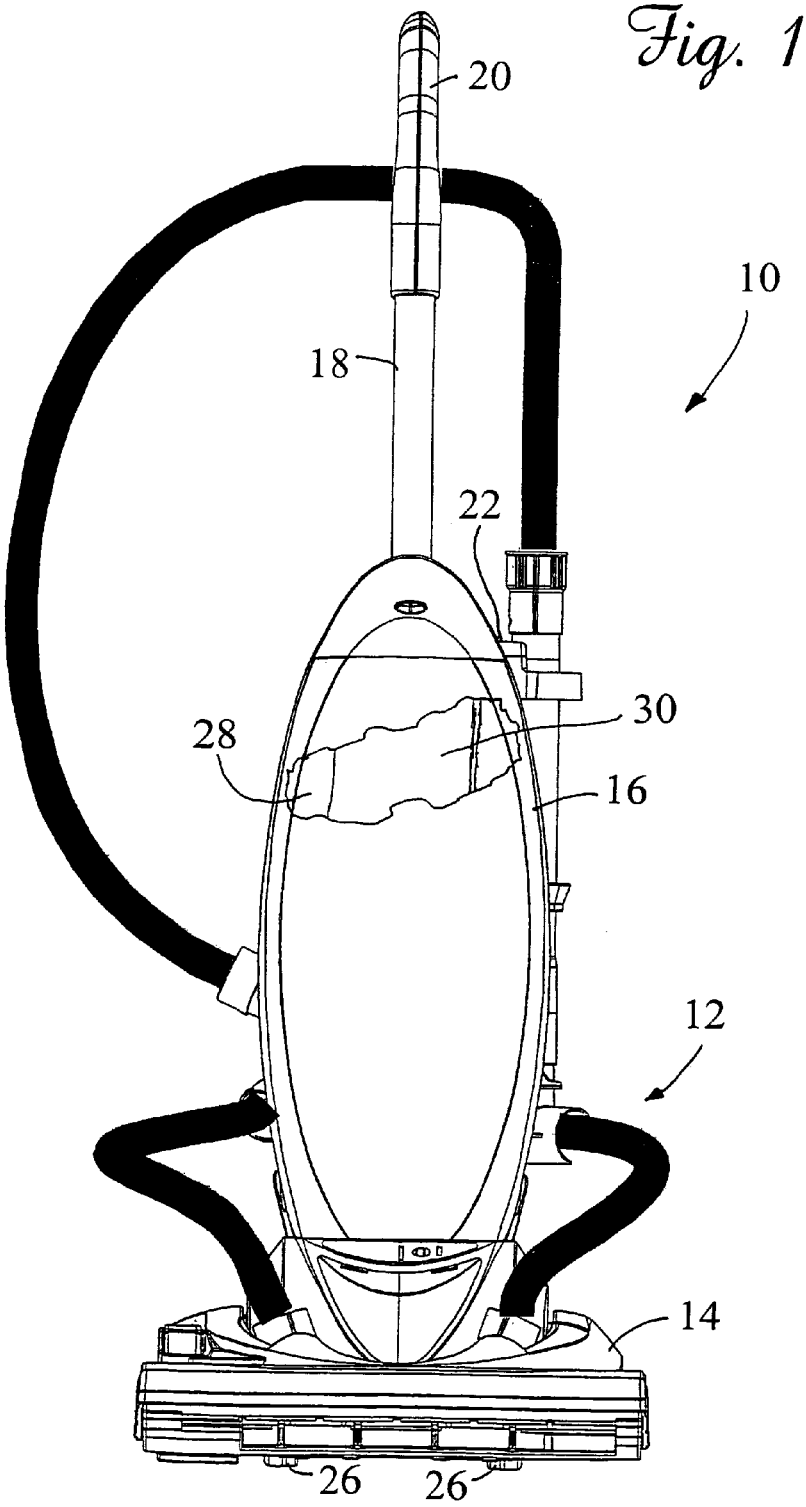
FIG. 1 is a partially broken-away, front elevational view of a floor care apparatus, in this instance an upright vacuum cleaner, constructed in accordance with the teachings of the present invention.
Figure 2:
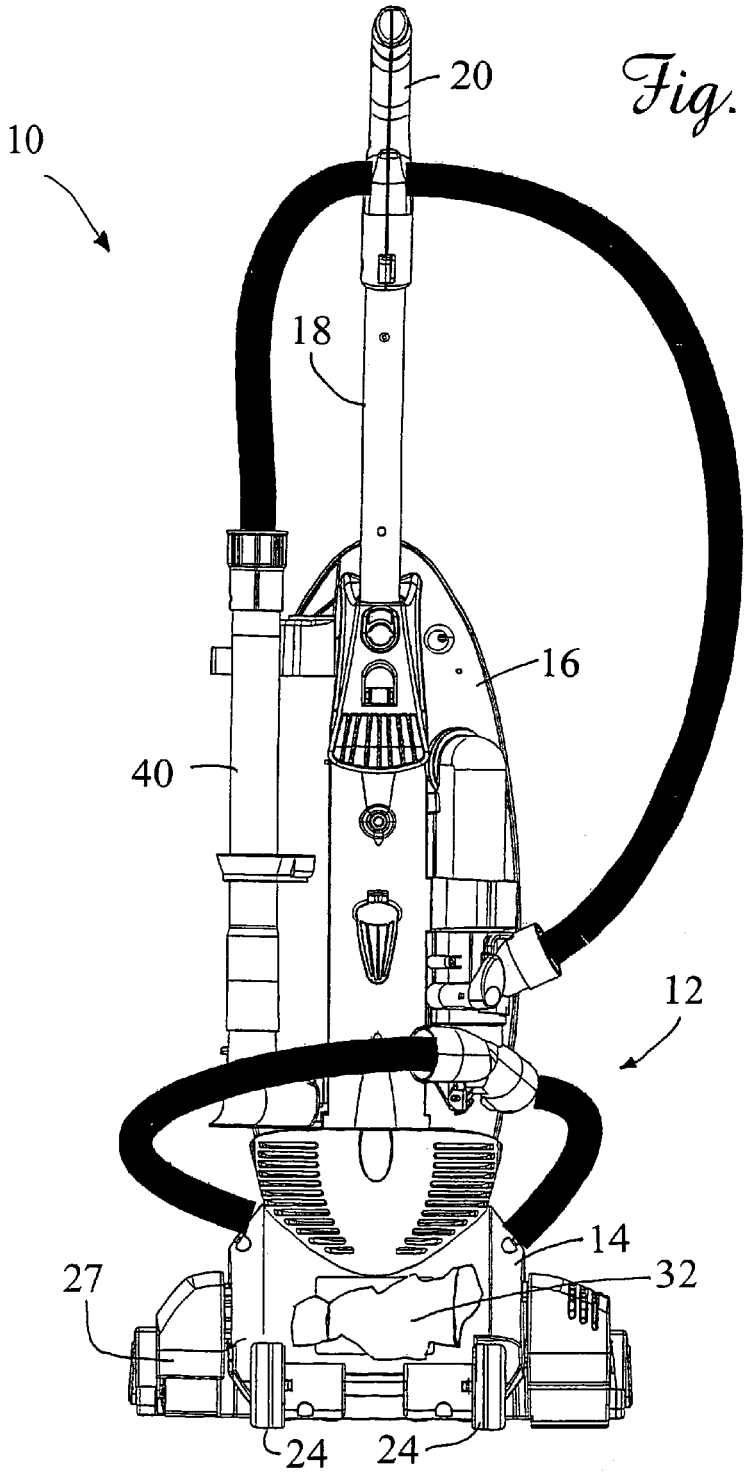
FIG. 2 is a partially broken-away, rear elevational view of the floor care apparatus shown in FIG. 1.

Reference is now made to FIGS. 1 and 2 showing a floor care apparatus 10 of the present invention. As illustrated, that apparatus 10 is an upright vacuum cleaner. It should be appreciated that while a specific upright vacuum cleaner 10 is illustrated, embodiments of the present invention also include different upright vacuum cleaners and extractors constructed in accordance with the teachings of the present invention.

The upright vacuum cleaner 10 includes a housing, generally designated by reference numeral 12, comprising a nozzle assembly 14 and a canister assembly 16. The canister assembly 16 further includes a control handle 18 and a hand grip 20. A control switch 22 is provided for turning the vacuum cleaner on and off. Of course, electrical power is supplied to the floor care apparatus 10 from a standard electrical wall outlet through an electrical cord (not shown).

A pair of rear wheels 24 are provided at a lower portion of the canister assembly 16 and a pair of front wheels 26 are provided on the nozzle assembly 14. Together these wheels 24, 26 support the apparatus 10 for movement across the floor. To allow for convenient storage of the apparatus 10, a foot latch functions to lock the canister assembly 16 in an upright position as shown in FIG. 1. When the foot latch 27 is released, the canister assembly 16 may be pivoted relative to the nozzle assembly 14 as the apparatus 10 is manipulated to and fro to clean the floor.

In the illustrated embodiment, the canister assembly 16 includes a cavity 28 adapted to receive and hold a dirt collector 30. The dirt collector 30 is shown as being a disposable dust bag but it should be appreciated that any form of dirt collecting device known in the art including, for example, a dirt cup could be utilized.

The canister assembly 16 further carries a suction generator 32 in the form of a suction fan and drive motor. The suction generator 32 functions to generate a vacuum air stream for drawing dirt and debris from the surface to be cleaned. While the suction generator 32 is illustrated as being carried on the canister assembly 16, it should be appreciated that it could likewise be carried on the nozzle assembly 14 if desired.

Figure 3:
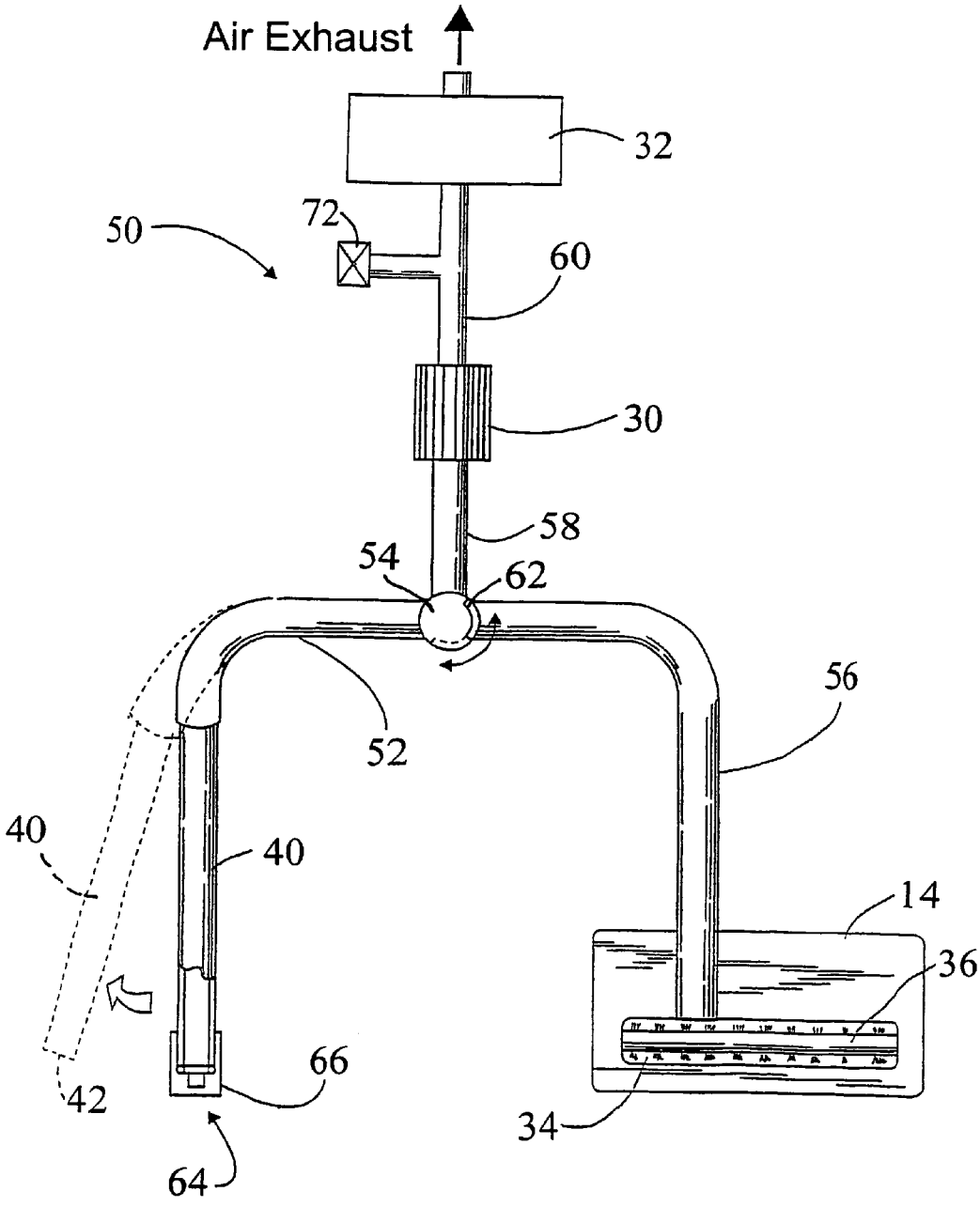
FIG. 3 is a schematical view of the floor care apparatus incorporating the airflow conduit system of the present invention.
Figure 4:
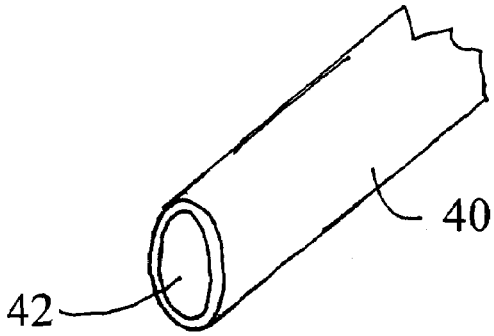
FIG. 4 is a detailed illustration of the inlet opening in the wand.

The nozzle assembly 14 includes a suction inlet 34 (see also FIG. 3). The suction inlet 34 may house a rotary agitator 36 that rotates relative to the nozzle assembly 14. That agitator 36 may be rotatably driven by a motor and cooperating gear drive housed within the agitator or a motor and belt and/or gear drive housed outside the agitator 36 within the nozzle assembly 14 and/or canister assembly 16.

In the illustrated apparatus 10, the scrubbing action of the rotary agitator 36 and the negative air pressure created by the suction generator 32 cooperate to brush and beat dirt and dust from the nap of the carpet being cleaned and then draw the dirt and dust laden air from the suction inlet 34 to the dirt collector 30 in a manner that will be described in greater detail below.

While the agitator 36 and suction inlet 34 of the nozzle assembly 14 provide a very efficient and effective way to clean an underlying bare floor, rug or carpet, such a structure is inappropriate for many cleaning tasks including tight comers and spaces where the nozzle assembly 12 cannot reach due to clearance limitations or for above floor cleaning applications such as the cleaning of draperies, windowsills or the like. In order to address this shortcoming, the apparatus 10 is also equipped with a wand 40 including an inlet opening 42 in the distal end thereof. Specifically, the operator may manually manipulate the wand 40 in order to bring the inlet opening 42 into contact or close proximity with the surface to be cleaned. Negative air pressure generated by the suction generator 32 draws dirt laden air into the inlet opening 42 and through the wand 40 for subsequent delivery to the dirt collector 30 in a manner described in greater detail below.

The airflow conduit system 50 of the present invention is generally shown in FIG. 3. The airflow conduit system 50 includes a first airflow pathway 52 which provides fluid communication between the inlet opening 42 of the wand 40 and the valve 54. A second airflow pathway 56 provides fluid communication between the suction inlet 34 of the nozzle assembly 14 and the valve 54. A third airflow pathway 58 provides fluid communication between the valve 54 and the dirt collector 30. A fourth airflow pathway 60 provides fluid communication between the dirt collector 30 and the suction generator 32.

The valve 54 includes a valve body 62 that is selectively displaceable between a closed position whereby the suction inlet 34 is sealed off from fluid communication with the suction generator 32 (note full line position shown in FIG. 3) and an open position whereby the suction inlet is in fluid communication with the suction generator 32 (not phantom line position shown in FIG. 3). Thus, it should be appreciated that the valve 54 exclusively controls the establishment and termination of fluid communication between the suction generator 32 and the suction inlet 34. Accordingly, the valve body 62 need only precisely seat in one position closing off the second airflow pathway 56. Thus, the valve 54 may be made more cheaply than prior art conversion or diverter valves which must precisely seat in two or more positions to selectively close off not only the suction inlet but also the inlet opening to the wand.

Figure 5:
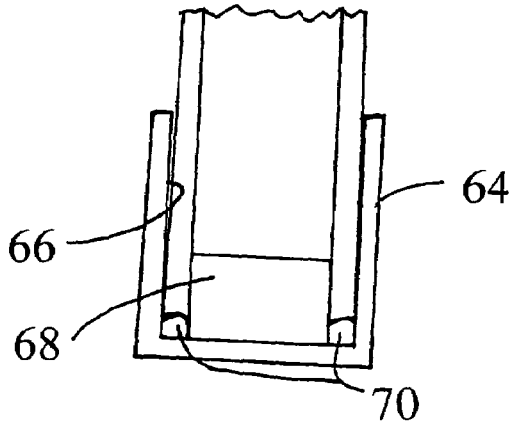
FIG. 5 is a detailed schematical illustration of the wand in the storage position.

When not in use, the wand 40 is secured in a storage position shown in full line in FIG. 3 and detail in FIG. 5. When in the storage position, the distal end of the wand 40 is held, for example, by friction fit, in a storage socket 64. In this arrangement the inner wall 66 of the storage socket 64 tightly engages the outer wall of the wand 40 and effectively seals the inlet opening 42 thereby functioning as a sealing element. Alternatively or still further, the socket member 64 may include a plug 68 that extends into and engages the inner wall of the wand 40 thereby completely filling the inlet opening 42. Such an arrangement may provide a secondary or alternative sealing element. Still further, the socket 64 may include a seal 70 such as an O-ring that engages the end of the wand 40 about the inlet opening 42 to provide complete sealing of the inlet opening when the wand 42 is in the storage position.

As should be appreciated, the storage socket 64 functions as a sealing element to completely seal the inlet opening 42 of the wand 40 when the wand is in the storage position. In contrast, when the wand is withdrawn from the socket 64 and manipulated for the purposes of cleaning (note phantom line showing in FIG. 3), the inlet opening 42 is opened and air is drawn through the wand 40 and the first and third airflow pathways 52, 58 to the dirt collector 30 where the dirt is removed from the air. The air is then drawn through the fourth airflow pathway 60 and passes through the suction generator 32 from which it is exhausted into the environment. If the operator desires to direct greater suction through the wand 40 for added cleaning power, the operator may adjust the valve 54 to the closed position thereby sealing off the second airflow pathway 56 and the suction inlet 34 of the nozzle assembly 14 from the suction generator 32. In this position the full negative pressure generated by the suction generator 32 is directed through the wand 40 to provide the most efficient cleaning action.

When the operator then desires to return to normal floor cleaning operation, the valve 54 is opened to re-establish fluid communication between the suction inlet 34 and the suction generator 32. The wand 40 is also replaced into the storage position in the storage socket 64 which functions through one or more of the wall 66, plug 68 and O-ring 70 to seal the inlet opening 42 of the wand 40. As a result, the entire negative pressure of the suction generator 32 flows through the suction inlet 34 to provide the most efficient and effective cleaning through the nozzle assembly 14.

In the event the operator simultaneously positions (a) the wand 40 in the storage position where the inlet opening 42 is sealed by the socket 64 and (b) the valve 54 in the closed position sealing the suction inlet 34 from the suction generator 32, negative pressure builds in the system and an increased load is placed on the suction generator. Upon reaching a predetermined internal negative pressure, a relief valve 72 provided in fluid communication with the conduit system 50 between the dirt collector 30 and the suction generator 32 (e.g. in direct communication with the fourth airflow pathway 60), opens so that air is drawn from the environment through the suction generator 32. This reduces the load on the suction generator 32 so as to extend the operating life of the suction generator. Once the operator reopens the fluid pathway to either the inlet opening 42 of the wand 40 or the suction inlet 34 of the nozzle assembly 14, there is a change in internal pressure within the airflow conduit system 40 and the relief valve 72 is biased closed thereby re-establishing the full cleaning power of the suction generator 32.

In summary, numerous benefits result from employing the concepts of the present invention. By providing a separate sealing element (storage socket 64, wall 66, plug 68 and/or O-ring 70) for the inlet opening 42 of the wand 40, the valve 54 need only be made to precisely seat in one sealing position. This substantially reduces tolerance and therefore machining requirements making the valve 54 less expensive to produce. Further, this relatively inexpensive valve still provides as good or better sealing action than standard three-position valves with two seating positions as are generally utilized for diverter/conversion valves in the art.

The foregoing description of the preferred embodiment of this invention has been presented for purposes of illustration and description. It is not intended to be exhaustive or to limit the invention to the precise form disclosed. Obvious modifications or variations are possible in light of the above teachings. For example, while the first airflow pathway 52 is illustrated as providing fluid communication between the wand 40 and the valve 54, it should be appreciated that connection to the valve 54 is not required. In fact, the first airflow pathway 52 could communicate with the second airflow pathway 56 or directly with the dirt collector 30 if desired.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. A floor care apparatus, comprising:

a housing including (a) a nozzle assembly having a suction inlet and (b) a canister assembly;

a dirt collector carried on said housing;

a suction generator carried on said housing;

a wand having an inlet opening;

a sealing element includes a plug filling and sealing said inlet opening when said wand is held in a storage position on said housing;

a valve; and an airflow conduit system providing fluid communication between said suction inlet, said inlet opening, said valve, said dirt collector and said suction generator;

said valve being selectively displaceable between a closed position whereby said suction inlet is sealed off from fluid communication with said suction generator and an open position whereby said suction inlet is in fluid communication with said suction generator;

said apparatus being further characterized by said sealing element further including a storage socket carried on said housing, said storage socket engaging a distal end of said wand including said inlet opening and thereby sealing said inlet opening.

2. The apparatus of claim 1, further including a pressure relief valve carried on said housing.

3. The apparatus of claim 1, wherein said airflow conduit system includes a first airflow pathway between said wand and said valve, a second airflow pathway between said suction inlet and said valve, a third airflow pathway between said valve and said dirt collector and a fourth airflow pathway between said dirt collector and said suction generator.

4. The apparatus of claim 3, wherein said dirt collector is a dirt cup.

5. The apparatus of claim 3, wherein said dirt collector is a bag.

6. The apparatus of claim 1, wherein said canister assembly is pivotally connected to said nozzle assembly.

7. The floor cleaning apparatus of claim 1, wherein said storage socket includes said plug that fills said inlet opening.

8. The floor cleaning apparatus of claim 1, wherein said storage socket includes an O-ring that engages said end of said wand about said inlet opening.

9. An airflow control system for a floor care apparatus including a suction generator and both a nozzle assembly with a main suction opening and a wand with an inlet opening, said system comprising:

a sealing element for including a plug filling and sealing off said wand adjacent said inlet opening when said wand is not in use; and a valve selectively displaceable between a closed position sealing off said main suction opening from said suction generator and an open position providing fluid communication between said main suction opening and said suction generator, said system being further characterized by said sealing element including a storage socket and an end of said wand including said inlet opening being received in said storage socket on said apparatus when not in use.

10. The airflow control system of claim 9 further including a pressure relief valve.

11. The airflow control system of claim 9, wherein said storage socket includes a wall that engages an outer wall of said wand adjacent said inlet opening.

12. The airflow control system of claim 11, wherein said plug is provided in said storage socket.

13. The airflow control system of claim 12, wherein said storage socket further includes an O-ring that engages said end of said wand about said inlet opening.

* * * * *